US009320963B2

(12) United States Patent
Alderucci et al.

(10) Patent No.: US 9,320,963 B2
(45) Date of Patent: Apr. 26, 2016

(54) TWO STAGE CARD SELECT

(75) Inventors: Dean P. Alderucci, New York, NY (US); Mark A. Miller, New York, NY (US)

(73) Assignee: CFPH, LLC, New York, NY (US)

( * ) Notice: Subject to any disclaimer, the term of this patent is extended or adjusted under 35 U.S.C. 154(b) by 1604 days.

(21) Appl. No.: 12/254,485

(22) Filed: Oct. 20, 2008

(65) Prior Publication Data

US 2010/0099481 A1 Apr. 22, 2010

(51) Int. Cl.
*A63F 1/00* (2006.01)
*G07F 17/32* (2006.01)

(52) U.S. Cl.
CPC ..... *A63F 1/00* (2013.01); *G07F 17/3293* (2013.01)

(58) Field of Classification Search
USPC ..... 463/11, 30
See application file for complete search history.

(56) References Cited

U.S. PATENT DOCUMENTS

| | | | |
|---|---|---|---|
| 4,266,770 | A | 5/1981 | Yeager |
| 4,531,187 | A | 7/1985 | Uhland |
| 4,926,327 | A | 5/1990 | Sidley |
| 5,255,915 | A | 10/1993 | Miller |
| 5,356,145 | A | 10/1994 | Verschoor |
| 5,586,766 | A | 12/1996 | Forte et al. |
| 5,605,334 | A | 2/1997 | McCrea, Jr. |
| 5,630,753 | A | 5/1997 | Fuchs |
| 5,682,550 | A | 10/1997 | Brown et al. |
| 5,692,748 | A | 12/1997 | Frisco et al. |
| 5,707,287 | A | 1/1998 | McCrea, Jr. |
| 5,803,808 | A | 9/1998 | Strisower |
| 5,836,586 | A | 11/1998 | Marks et al. |
| 5,851,147 | A | 12/1998 | Stupak et al. |
| 5,941,769 | A | 8/1999 | Order |
| 5,967,894 | A | 10/1999 | Kinoshita et al. |
| 6,126,541 | A | 10/2000 | Fuchs |
| 6,139,014 | A | 10/2000 | Breeding et al. |
| 6,217,447 | B1 | 4/2001 | Lofink et al. |
| 8,001,079 | B2 | 8/2001 | Lu et al. |
| 6,299,536 | B1 | 10/2001 | Hill |
| 6,386,973 | B1 | 5/2002 | Yoseloff |
| 6,585,591 | B1 | 7/2003 | Baerlocher et al. |

(Continued)

FOREIGN PATENT DOCUMENTS

| | | |
|---|---|---|
| JP | 58-081059 | 5/1983 |
| JP | 10-507103 | 7/1998 |
| WO | WO/96/04970 | 2/1996 |

OTHER PUBLICATIONS

U.S. Appl. No. 11/850,565, filed Sep. 5, 2007, Lutnick et al.

(Continued)

*Primary Examiner* — Masud Ahmed
(74) *Attorney, Agent, or Firm* — Mark Miller

(57) ABSTRACT

A method and/or device is set forth for playing a game. In some embodiments, an inventory of data representing playing cards is arranged in a random but established, serial order. In some embodiments, for each hand of play the player makes a wager and cards are displayed, according to the rules of the game, in order from the inventory to define a winning or losing outcome. In some embodiments, a display, as hands are played, displays the remaining constituency of the inventory and the player, before any hand, can order re-shuffling and re-constitute of the inventory. In some embodiments, re-shuffling may be triggered by a card or hand count or certain pre-defined triggers. Other embodiments are described.

15 Claims, 4 Drawing Sheets

(56) References Cited

U.S. PATENT DOCUMENTS

| | | | |
|---|---|---|---|
| 6,612,926 | B1 | 9/2003 | Dabrowski |
| 6,663,487 | B1 | 12/2003 | Ladner |
| 6,811,486 | B1 | 11/2004 | Luciano, Jr. |
| 6,811,488 | B2 | 11/2004 | Paravia et al. |
| 6,869,074 | B2 | 3/2005 | Miller |
| 7,056,205 | B2 | 6/2006 | Odom |
| 7,086,943 | B2 | 8/2006 | Mugnolo et al. |
| 7,114,718 | B2 | 10/2006 | Grauzer et al. |
| 7,182,690 | B2 | 2/2007 | Giobbi et al. |
| 7,341,519 | B2 | 3/2008 | McMain et al. |
| 7,419,162 | B2 | 9/2008 | Lancaster et al. |
| 7,425,178 | B1 | 9/2008 | Odom |
| 7,431,648 | B2 | 10/2008 | Odom |
| 7,523,941 | B2 | 4/2009 | Thomas et al. |
| 7,530,572 | B2 | 5/2009 | Thomas et al. |
| 7,611,409 | B2 | 11/2009 | Muir et al. |
| 7,637,506 | B2 | 12/2009 | Naicker |
| 7,717,429 | B2 | 5/2010 | Lutnick et al. |
| 7,811,167 | B2 | 10/2010 | Giobbi et al. |
| 7,914,369 | B2 | 3/2011 | Walker et al. |
| 7,942,418 | B2 | 5/2011 | Amaitis et al. |
| 8,079,595 | B2 | 12/2011 | Amaitis et al. |
| 8,096,555 | B1 | 1/2012 | Odom et al. |
| 8,113,941 | B2 | 2/2012 | Gomez et al. |
| 8,137,173 | B2 | 3/2012 | Miller |
| 8,147,307 | B2 | 4/2012 | Miller |
| 8,147,308 | B2 | 4/2012 | Miller |
| 8,192,266 | B2 | 6/2012 | Alderucci et al. |
| 8,226,460 | B2 | 7/2012 | Miller |
| 8,287,346 | B2 | 10/2012 | Miller |
| 8,308,543 | B2 | 11/2012 | Miller |
| 8,317,620 | B2 | 11/2012 | Kelly et al. |
| 8,408,988 | B2 | 4/2013 | Miller |
| 8,523,183 | B2 | 9/2013 | Amaitis et al. |
| 8,523,684 | B2 | 9/2013 | Lutnick et al. |
| 8,657,291 | B2 | 2/2014 | Lutnick et al. |
| 8,657,656 | B2 | 2/2014 | Miller |
| 8,662,978 | B2 | 3/2014 | Miller |
| 8,944,901 | B2 | 2/2015 | Alderucci et al. |
| 9,061,203 | B2 | 6/2015 | Miller |
| 2001/0035608 | A1 | 11/2001 | Hoyt et al. |
| 2002/0068635 | A1 | 6/2002 | Hill |
| 2002/0090985 | A1 | 7/2002 | Tochner |
| 2002/0098888 | A1 | 7/2002 | Rowe et al. |
| 2002/0103017 | A1 | 8/2002 | Odom et al. |
| 2002/0155872 | A1 | 10/2002 | Odom et al. |
| 2002/0195773 | A1 | 12/2002 | Dunn |
| 2003/0064805 | A1 | 4/2003 | Wells |
| 2003/0109310 | A1 | 6/2003 | Heaton et al. |
| 2004/0072607 | A1 | 4/2004 | Thomas et al. |
| 2004/0082373 | A1 | 4/2004 | Cole et al. |
| 2004/0142742 | A1 | 7/2004 | Schneider et al. |
| 2005/0037834 | A1 | 2/2005 | Stern et al. |
| 2005/0059452 | A1 | 3/2005 | Hartl |
| 2005/0101383 | A1 | 5/2005 | Wells |
| 2005/0130728 | A1 | 6/2005 | Nguyen et al. |
| 2005/0143158 | A1* | 6/2005 | Odom et al. ..... 463/13 |
| 2005/0161882 | A1 | 7/2005 | Miller |
| 2005/0181851 | A1 | 8/2005 | Amaitis et al. |
| 2005/0187020 | A1 | 8/2005 | Amaitis et al. |
| 2006/0035707 | A1 | 2/2006 | Nguyen |
| 2006/0079308 | A1 | 4/2006 | Asher et al. |
| 2006/0121978 | A1 | 6/2006 | Hornik et al. |
| 2006/0151954 | A1 | 7/2006 | Silverman |
| 2006/0183540 | A1 | 8/2006 | Grauzer et al. |
| 2006/0189382 | A1 | 8/2006 | Muir et al. |
| 2006/0247064 | A1 | 11/2006 | Nguyen |
| 2007/0001398 | A1 | 1/2007 | Walker et al. |
| 2007/0021198 | A1 | 1/2007 | Muir |
| 2007/0054721 | A1 | 3/2007 | Jackson |
| 2007/0111772 | A1 | 5/2007 | Shuster et al. |
| 2007/0243935 | A1 | 10/2007 | Huizinga |
| 2007/0254732 | A1 | 11/2007 | Walker et al. |
| 2007/0270224 | A1 | 11/2007 | Abbott |
| 2008/0054568 | A1 | 3/2008 | Lutnick et al. |
| 2008/0067743 | A1 | 3/2008 | Naicker |
| 2008/0090650 | A1 | 4/2008 | Tarantino |
| 2008/0119257 | A1 | 5/2008 | Stern et al. |
| 2008/0182644 | A1 | 7/2008 | Lutnick et al. |
| 2009/0005145 | A1* | 1/2009 | White ..... 463/16 |
| 2009/0104960 | A1 | 4/2009 | Kelly et al. |
| 2009/0325706 | A1 | 12/2009 | Geist, Jr. et al. |
| 2010/0009737 | A1 | 1/2010 | Lutnick et al. |
| 2010/0009743 | A1 | 1/2010 | Amaitis et al. |
| 2010/0099477 | A1 | 4/2010 | Alderucci et al. |
| 2010/0099478 | A1 | 4/2010 | Alderucci et al. |
| 2010/0099479 | A1 | 4/2010 | Miller |
| 2010/0099481 | A1 | 4/2010 | Alderucci et al. |
| 2010/0105457 | A1 | 4/2010 | Miller |
| 2010/0105458 | A1 | 4/2010 | Miller |
| 2010/0105459 | A1 | 4/2010 | Miller |
| 2010/0105461 | A1 | 4/2010 | Miller |
| 2010/0105465 | A1 | 4/2010 | Miller |
| 2010/0113119 | A1 | 5/2010 | Miller |
| 2010/0113126 | A1 | 5/2010 | Miller |
| 2010/0113137 | A1 | 5/2010 | Miller |
| 2010/0113162 | A1 | 5/2010 | Vemuri et al. |
| 2010/0120483 | A1 | 5/2010 | Lutnick et al. |
| 2011/0180993 | A1 | 7/2011 | Amaitis et al. |
| 2012/0056374 | A1 | 3/2012 | Lutnick et al. |
| 2012/0058814 | A1 | 3/2012 | Lutnick et al. |

OTHER PUBLICATIONS

U.S. Appl. No. 11/669,996, filed Feb. 1, 2007, Lutnick et al.
U.S. Appl. No. 11/972,002, filed Jan. 10, 2008, Amaitis et al.
U.S. Appl. No. 12/169,383, filed Jul. 8, 2008, Lutnick et al.
U.S. Appl. No. 12/252,488, filed Oct. 16, 2008, Alderucci et al.
U.S. Appl. No. 12/253,343, filed Oct. 17, 2008, Alderucci et al.
U.S. Appl. No. 12/255,123, filed Oct. 21, 2008, Miller.
U.S. Appl. No. 12/256,634, filed Oct. 23, 2008, Miller.
U.S. Appl. No. 12/256,640, filed Oct. 23, 2008, Miller.
U.S. Appl. No. 12/257,649, filed Oct. 24, 2008, Miller.
U.S. Appl. No. 12/259,325, filed Oct. 28, 2008, Miller.
U.S. Appl. No. 12/259,330, filed Oct. 28, 2008, Miller.
U.S. Appl. No. 12/263,768, filed Nov. 3, 2008, Miller.
U.S. Appl. No. 12/263,779, filed Nov. 3, 2008, Miller.
U.S. Appl. No. 12/263,789, filed Nov. 3, 2008, Miller.
USPTO Office Action for U.S. Appl. No. 12/688,422, dated Nov. 15, 2010 (7 pages).
USPTO Office Action for U.S. Appl. No. 11/972,002, dated Oct. 20, 2010 (6 pages).
"Baccarat—Learn to play like a professional with a unique free evaluation—Save Money", 4 pages; Accessed Oct. 13, 2008; http://web.archive.org/web/20010603045041/www.happyfortune.com/features.htm.
"Casino Verite Blackjack History", 8 pages; Accessed Oct. 13, 2008; http://web.archive.org/web/20010819115538/www.qfit.com/cvhist.htm.
Blackjack Table Image, 1 page; Accessed Oct. 13, 2008; http://web.archive.org/web/20010414005535/www.qfit.com/cvssb1.htm.
"Counting Cards", 1 page; Accessed Oct. 13, 2008; http://web.archive.org/web/20010715031334/www.casinosoftware.net/software/html/CC2Setup.zip.html.
"Deck of Cards.Java Programming Assignment"; 4 pages; Accessed Oct. 13, 2008 http://web.archive.org/web/20010418172543/www.cs.clemson.edu/~pargas/courses/cs241/current/assignments/spring2001/p1/DeckOfCards.html.
"Baccarat—Learn to play like a professional with a unique free evaluation—Features", 4 pages; Accessed Oct. 13, 2008 http://web.archive.org/web/20010603045041/www.happyfortune.com/features.htm.
U.S. Appl. No. 60/824,522, filed Sep. 5, 2006, Lutnick et al.
U.S. Appl. No. 60/824,648, filed Sep. 6, 2006, Lutnick et al.
USPTO Notice of Allowance and Fees Due for U.S. Appl. No. 11/972,002, dated Feb. 4, 2011 (7 pages).
USPTO Office Action for U.S. Appl. No. 12/169,383, dated Mar. 28, 2011 (11 pages).
Japanese Office Action with English Translation for Application No. 2009-518656, mailed Mar. 15, 2011 (6 pages).

(56) References Cited

OTHER PUBLICATIONS

USPTO Office Action for U.S. Appl. No. 12/252,488, dated Mar. 31, 2011 (7 pages).
USPTO Office Action for U.S. Appl. No. 12/255,123, dated Apr. 20, 2011 (6 pages).
USPTO Office Action for U.S. Appl. No. 12/256,634, dated Apr. 6, 2011 (8 pages).
USPTO Office Action for U.S. Appl. No. 12/259,325, dated Apr. 13, 2011 (8 pages).
USPTO Office Action for U.S. Appl. No. 12/263,768, dated Apr. 25, 2011 (6 pages).
Australian Examiner's Report for Australian Application No. 2007292385, dated May 26, 2011 (3 pages).
USPTO Office Action for U.S. Appl. No. 11/850,565, dated May 12, 2011 (7 pages).
U.S. Appl. No. 12/688,422, filed Jan. 15, 2010, Lutnick et al.
Canadian Examiner's Report for Application No. 2,625,171 dated Oct. 7, 2009 (4 pages).
Notification of Transmittal of the International Search Report and Written Opinion for International Application No. PCT/US07/77646, dated Sep. 30, 2008 (11 pages).
International Preliminary Report on Patentability for International Application No. PCT/US07/77646, dated Mar. 10, 2009 (6 pages).
USPTO Office Action for U.S. Appl. No. 11/669,996; dated Feb. 17, 2009 (11 pages).
USPTO Examiner Interview Summary for U.S. Appl. No. 11/669,996; dated Jun. 17, 2009 (4 pages).
Olaf Vancura & Ken Fuchs, Knock-Out Blackjack, Sep. 1998, Huntington Press, 1st Edition, pp. 43-72.
Notification of Transmittal of the International Search Report and Written Opinion for International Application No. PCT/US08/52461, dated Jul. 8, 2008 (10 pages).
International Preliminary Report on Patentability for International Application No. PCT/US08/52461, dated Aug. 4, 2009 (6 pages).
Australian Examiner's Report for Australian Application No. 2008201369, dated Aug. 26, 2009 (2 pages).
Australian Examiner's Report for Australian Application No. 2007292385, dated May 28, 2010 (2 pages).
USPTO Examiner Interview Summary for U.S. Appl. No. 11/669,996; dated Nov. 23, 2009 (2 pages).
USPTO Notice of Allowance and Fees Due for U.S. Appl. No. 11/669,996; dated Nov. 23, 2009 (8 pages).
USPTO Office Action for U.S. Appl. No. 11/972,002, Mar. 19, 2010 (6 pages).
USPTO Supplemental Notice of Allowability for U.S. Appl. No. 11/669,996, Apr. 6, 2010 (4 pages).
USPTO Office Action for U.S. Appl. No. 11/972,002, Jun. 3, 2010 (8 pages).
USPTO Office Action for U.S. Appl. No. 12/252,488, dated Nov. 2, 2011 (4 pages).
USPTO Notice of Allowance and Fees Due for U.S. Appl. No. 12/256,634, dated Nov. 7, 2011 (5 pages).
USPTO Office Action for U.S. Appl. No. 12/259,325, dated Nov. 21, 2011 (6 pages).
USPTO Office Action for U.S. Appl. No. 11/850,565, dated Dec. 27, 2011 (14 pages).
USPTO Office Action for U.S. Appl. No. 13/081,787, dated Jan. 30, 2012 (6 pages).
USPTO Notice of Allowance and Fees Due for U.S. Appl. No. 12/263,768, dated Dec. 5, 2011 (5 pages).
Australian Examiner's Report for Australian Application No. 2007292385, dated Dec. 7, 2011 (3 pages).
USPTO Notice of Allowance and Fees Due for U.S. Appl. No. 12/255,123, dated Dec. 2, 2011 (5 pages).
USPTO Notice of Allowance and Fees Due for U.S. Appl. No. 12/252,488, dated Feb. 8, 2012 (5 pages).
USPTO Notice of Allowance and Fees Due and Examiner Interview Summary Record for U.S. Appl. No. 12/688,422, dated Aug. 12, 2011 (11 pages).
USPTO Office Action for U.S. Appl. No. 12/256,640, dated Sep. 19, 2011 (26 pages).
USPTO Office Action for U.S. Appl. No. 12/257,649, dated Jun. 24, 2011 (6 pages).
USPTO Office Action for U.S. Appl. No. 12/259,330, dated Oct. 4, 2011 (25 pages).
USPTO Office Action for U.S. Appl. No. 12/263,779, dated Jul. 22, 2011 (15 pages).
USPTO Office Action for U.S. Appl. No. 12/263,789, dated Sep. 20, 2011 (23 pages).
Canadian Examiner's Report for Application No. 2,662,856, dated Aug. 19, 2011 (3 pages).
USPTO Office Action for U.S. Appl. No. 12/253,343, dated Oct. 12, 2011 (11 pages).
Australian Notice of Acceptance for Application No. 2007292385, dated Feb. 29, 2012 (3 pages).
USPTO Notice of Allowance and Fees Due for U.S. Appl. No. 12/257,649, dated Mar. 27, 2012 (8 pages).
USPTO Office Action for U.S. Appl. No. 12/263,779, dated Mar. 20, 2012 (14 pages).
Japanese Office Action with English Translation for Application No. 2009-527543, mailed Mar. 21, 2012 (8 pages).
Japanese Office Action with English Translation for Application No. 2009-518656, mailed Apr. 24, 2012 (16 pages).
"Blackjack" (Japanese text), Wikipedia, Jan. 23, 2007 (retrieved on Apr. 9, 2012).
USPTO Office Action for U.S. Appl. No. 13/163,991, dated Jul. 10, 2012 (11 pages).
USPTO Office Action for U.S. Appl. No. 13/297,892, dated Jul. 19, 2012 (12 pages).
USPTO Office Action for U.S. Appl. No. 13/081,787, dated Jul. 25, 2012 (3 pages).
USPTO Office Action for U.S. Appl. No. 12/253,343, dated Aug. 21, 2012 (10 pages).
USPTO Notice of Allowance and Fees Due for U.S. Appl. No. 13/409,349; dated Jun. 8, 2012 (10 pages).
USPTO Office Action and Examiner Interview Summary Record for U.S. Appl. No. 12/256,640, dated Jul. 6, 2012 (27 pages).
USPTO Office Action for U.S. Appl. No. 12/259,325, dated Jun. 19, 2012 (3 pages).
USPTO Notice of Allowance and Fees Due and Examiner Interview Summary for U.S. Appl. No. 12/259,330; dated Jul. 9, 2012 (14 pages).
USPTO Notice of Allowance and Fees Due for U.S. Appl. No. 12/263,789; dated Jun. 13, 2012 (17 pages).
USPTO Office Action for U.S. Appl. No. 12/169,383, dated Oct. 9, 2012 (15 pages).
USPTO Office Action for U.S. Appl. No. 12/169,383, dated Oct. 19, 2012 (3 pages).
Australian Examiner's Report for Australian Application No. 2012202693, dated Jan. 14, 2013 (2 pages).
Canadian Examiner's Report for Application No. 2,662,856, dated Nov. 13, 2012 (5 pages).
USPTO Notice of Allowance and Fees Due for U.S. Appl. No. 12/259,325, dated Jan. 11, 2013 (5 pages).
USPTO Notice of Allowance and Fees Due for U.S. Appl. No. 12/263,779, dated Nov. 26, 2012 (15 pages).
USPTO Pre-Brief Appeal Conference Decision for U.S. Appl. No. 12/263,779, dated Jan. 3, 2013 (2 pages).
USPTO Office Action for U.S. Appl. No. 13/297,892, dated Mar. 22, 2013 (8 pages).
USPTO Office Action for U.S. Appl. No. 11/850,565, dated Apr. 26, 2013 (14 pages).
USPTO Notice of Allowance and Fees Due for U.S. Appl. No. 11/850,565, dated May 15, 2013 (20 pages).
Japanese Office Action with English Translation for Application No. 2009-518656, mailed Apr. 16, 2013 (11 pages).
USPTO Notice of Allowance and Fees due for U.S. Appl. No. 13/081,787, dated May 1, 2013 (21 pages).
USPTO Pre-Brief Appeal Conference Decision for U.S. Appl. No. 12/169,383, dated Apr. 24, 2013 (2 pages).
USPTO Pre-Brief Appeal Conference Decision for U.S. Appl. No. 12/253,343, dated Apr. 10, 2013 (10 pages).

(56) References Cited

OTHER PUBLICATIONS

USPTO Office Action for U.S. Appl. No. 13/555,300, dated Jul. 5, 2013, 10 pages.
USPTO Office Action for U.S. Appl. No. 12/259,325, dated Apr. 24, 2013 (12 pages).
Canadian Examiner's Report for Application No. 2,625,171, dated Aug. 13, 2013 (5 pages).
USPTO Notice of Allowance and Fees due for U.S. Appl. No. 13/297,892, Oct. 8, 2013 (11 pages).
USPTO Office Action for U.S. Appl. No. 13/616,156, dated Oct. 10, 2013 (9 pages).
USPTO Notice of Allowance and Fees Due for U.S. Appl. No. 13/437,441, dated Oct. 21, 2013 (7 pages).
USPTO Notice of Allowance and Fees Due for U.S. Appl. No. 12/259,325, dated Dec. 13, 2013 (7 pages).
Japanese Office Action with English Translation for Application No. 2012-208539, mailed Feb. 4, 2014 (6 pages).
USPTO Office Action for U.S. Appl. No. 12/169,383, dated Feb. 28, 2014 (14 pages).
USPTO Office Action for U.S. Appl. No. 13/487,417, dated Apr. 17, 2014 (8 pages).
USPTO Notice of Allowance and Fees Due for U.S. Appl. No. 13/616,156, dated May 9, 2014 (5 pages).
USPTO Office Action for U.S. Appl. No. 13/555,300, dated Apr. 23, 2014, 9 pages.
Australian Examiner's Report for Australian Application No. 2012202693, dated Oct. 14, 2014 (3 pages).
Canadian Examination Report for Application No. 2,662,856, dated Dec. 9, 2014 (5 pages).
European Search Report for Application No. 07814692.5 dated Dec. 22, 2014 (7 pages).
Canadian Examination Report for Application No. 2,625,171 dated Dec. 30, 2014 (5 pages).
Japanese Office Action for Application No. 2013-169182 mailed Dec. 2, 2014 (8 pages).
European Extended Search Report for Application No. 07814692.5 dated Apr. 20, 2015 (10 pages).
Australian Examiner's Report for Australian Application No. 2014250611, dated Jul. 9, 2015 (2 pages).
Japanese Office Action with English Translation for Application No. 2012-208539, mailed May 12, 2015 (6 pages).

* cited by examiner

TWO STAGE CARD SELECT

DESCRIPTION

Figure 1:
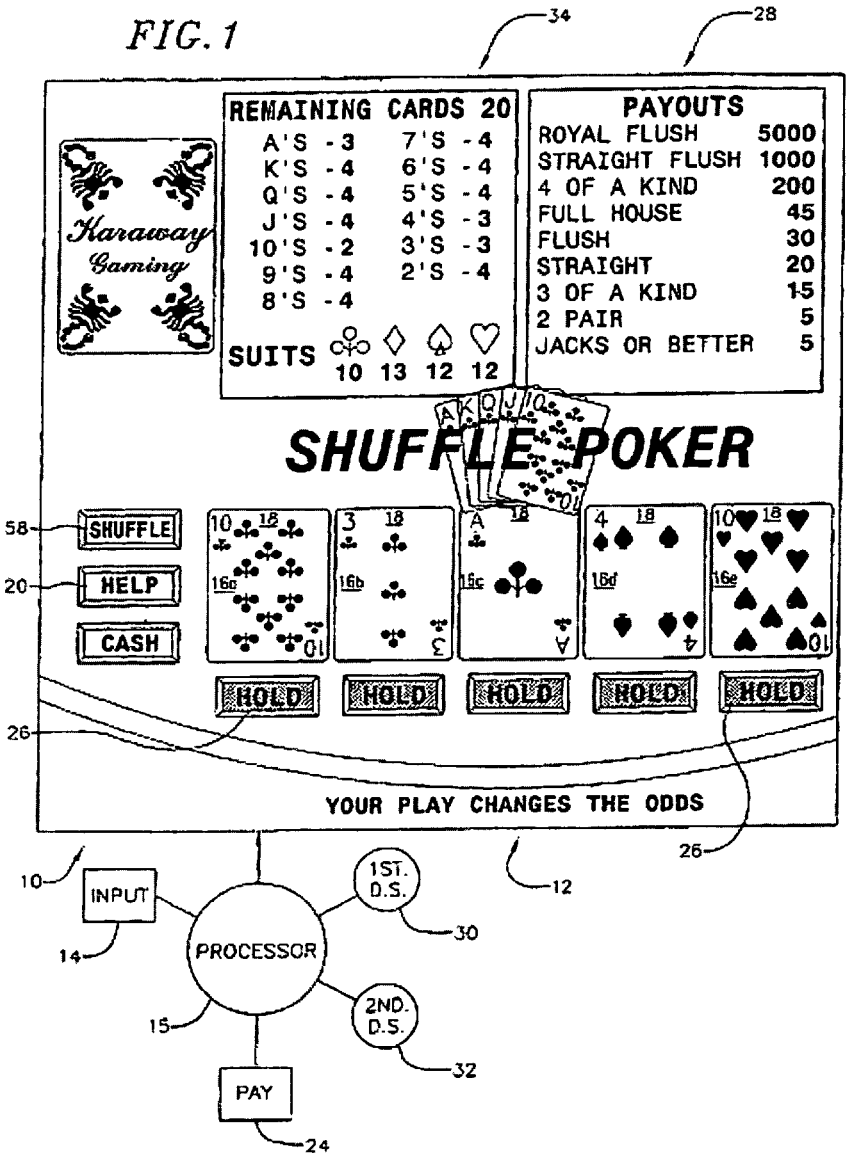
FIG. 1 shows a processor controlled display after the play of one hand of Video Poker.

U.S. patent application Ser. No. 09/977,138 entitled "Electronic Card Game and Method," filed Oct. 12, 2001, U.S. Provisional Application Ser. No. 60/241,644 entitled "Electronic Video Poker Game and Method," filed Oct. 19, 2000, U.S. patent application Ser. No. 09/942,520 entitled "Live And Electronic Wagering And Lottery Game," filed Aug. 29, 2001, U.S. Provisional Application Ser. No. 60/229,665 entitled "Live and Electronic Wagering and Lottery Game," filed Aug. 31, 2000, and U.S. patent application Ser. No. 11/007,108, entitled "Method of conducting a wagering game with continuous depletion," filed Dec. 7, 2004 are all hereby incorporated herein by reference.

Some embodiments of the present invention relate to methods and devices for playing electronic video Poker, Blackjack and other card games.

Video Poker is a well known game that may be played using an electronic device such as a computer with a display, a hand-held device or with a dedicated, video Poker gaming machine. In some embodiments, the play of basic video Poker is the same whether it is played with a hand held, electronic novelty device, with a computer, through the Internet or with a dedicated gaming machine. Some of the following description is primarily directed to a dedicated, video Poker gaming or video lottery machine of the type found in casinos.

To play the game according to some embodiments, the player makes a wager by any suitable means such as by wagering credits, inserting tokens or the like. In some implementations, once the wager is made the machine is prompted for play whereupon the processor for machine randomly selects from data representing a deck of playing cards, data representing ten playing cards. In some implementations, this data may not be arranged in any order and typically is configured as a data string representing the cards of the deck in no particular order. In some implementations, this order is fixed when the data string is constructed; however the random selection from the string in some implementations makes the fixed order, at least to a degree, irrelevant. In some implementations, from this randomly selected data, five playing cards are displayed representing the initial holding and the data for the remaining ten cards is held in inventory. In some implementations, the player, using a touch screen on the game display or buttons on the machine, selects which cards to discard, if any, from the initial holding. In some implementations, the data representing the discarded cards is replaced with the inventoried data and the replacement cards are displayed. In some implementations, the final hand is (with or without replacement cards) is compared to a schedule of winning hands based on the ranking of hands of Poker. If the player has a winning final hand, they are paid based upon their wager. If they do not have a winning hand, their wager is lost. In some implementations, after determination of the outcome of the hand, the player makes another wager and plays the next hand according to the above.

In some embodiments, for each new hand of play, the initial hand is selected from data representing a full deck of cards. This deck may have the standard fifty-two cards or may include an additional, wild, Joker. In this regard, it is further known to provide games according to the above based upon a deuces wild, Joker's wild and Joker's and deuces wild format. In some implementations, the play of a hand does not deplete the deck data stored for the next hand. In some implementations, the device does not track nor display cards remaining in the deck since there is no deck depletion as hands are played. In some implementations, there is no means for the player to select to "reshuffle" or not reshuffle after a series of hand.

Video Blackjack is also a known game. According to this game, the player makes a wager and data representing a two card player hand and two card dealer hand are randomly selected and displayed from a full deck of fifty-two cards. The cards of the player hand are revealed whereas only one card of the dealer hand is shown. The player, using an input device, opts to stand, split, double down and take one or more hits to complete his hand according to the rules of the game. The dealer's hand is then revealed and completed. As between the dealer and player, the one having a hand count at or closest to "21" wins the hand. In some implementations, after the hands are completed and compared and any wager paid or collected, a new wager is made and cards are dealt from a fully constituted deck.

In some embodiments, for the table game version of Blackjack, a series of hands are dealt from a deck and the deck is depleted to a point where the deck is re-shuffled.

Baccarat is another known game where, in some implementations, a deck of cards is shuffled to configure the cards into a random, serial order and where multiple hands are dealt from the deck before a point is reached in penetration through the deck where the deck is re-shuffled.

Further, in regards to deck depletion through a series of hands for the play of games of the type described, the same does not occur with respect to some implementations of electronic card games since the deck is fully constituted at the start of each hand. Further, where a deck is depleted over a series of hands, some implementations may include displaying to players the remaining constituency of the depleted deck so they can see the cards available for play. In most jurisdictions, card counting, e.g. a player determining the remaining cards in the deck based upon the cards played (in Blackjack where multiple rounds of hands are played from a deck of cards) is a crime or a basis for ejecting the player from the casino.

In some embodiments, at least for a plurality of hands of play, the cards which have been played deplete the deck for the succeeding hand. In some embodiments, a processor tracks the cards which have been played and therefore can determine and display, if desired, the inventory of cards remaining in the deck for play of the next hand. Some embodiments include a game where the player can order "reshuffling" if he/she desires. Some embodiments include a game of the type described above where re-shuffling of the deck data, if not ordered by the player, is required based upon one or more pre-selected triggers.

Some embodiments include a method and/or electronic device for playing a card game such as a Video Poker game where the deck(s) are randomized (shuffled) into a random, serial order 1-N, where cards for play are selected and displayed in serial order for the deck, where the constituency of the deck. i.e. the remaining cards available for play, are displayed and where the deck is reconstituted and reconfigured into a new, random, serially arranged deck of N cards based upon the count of displayed cards, a command prompt by the player or a pre-determined trigger and where the displayed pay table may be reconfigured to reflect the fact that, based upon depletion of the deck, certain winning outcomes cannot obtained.

Some embodiments include a method and/or device for playing a card game such as a Video Poker game which includes providing a data processor including a first data structure storing data representing at least one deck of N playing cards according to the rules of the game. For example, for some implementations of regular Poker, the first data structure would store data representing each card of a fifty-two card deck. In the first data structure the card data is configured a random, serial order representing a deck of shuffled cards. The player makes a wager and plays a series of hands. For each hand of play, data is selected from the first data structure and displaying at an electronic display data representing an initial holding of at least three playing cards, e.g. a five card Poker hand, the data selected in order from the serially arranged deck data. The player opts to discard one or more of said displayed playing cards of the initial holding, the processor for any discarded card selecting and displaying a replacement card selected in order for the serially arranged deck data to define a final outcome, five card, combination. The final card combination is compared to data stored in a second data structure storing data representing winning outcomes. If the player has obtained a winning outcome an award corresponding to a winning outcome is issued to the player. It should be recognized that this example is non-limiting and that other embodiments may not involve serial orders, such data structures, and/or may include any other elements or methods.

In some embodiments, a processor maintains data representing the constituency of the deck data remaining in the first data structure, e.g. how many Aces-Deuces are left, and displays the constituency of the deck data depleted of said displayed cards. Thus, in some implementations, as cards are selected from the serially arranged deck and before the next hand of play, there is displayed for the player the remaining constituency of the deck which the player may use to guide their decisions as to which cards to discard. It should be recognized that other embodiments may not include such elements or actions and/or may include alternatives.

In some embodiments, the feature of displaying the remaining constituency of the deck through the play of a series of hands may also be incorporated into video versions of Blackjack, Baccarat and other games.

In some embodiments, at a predetermined count of selected cards, the deck data is reconstituted and reconfigured such that the cards are randomly positioned in a serially ordered deck representing a re-shuffled deck. In some embodiments, as new hands are played cards are selected in series form the deck data so as to correspond to dealing of cards from the top of the deck. In some embodiments, reconstitution and reconfiguration may also be triggered, as by the play of the Joker in Joker's Wild Poker or upon prompting by the player.

Figure 2:
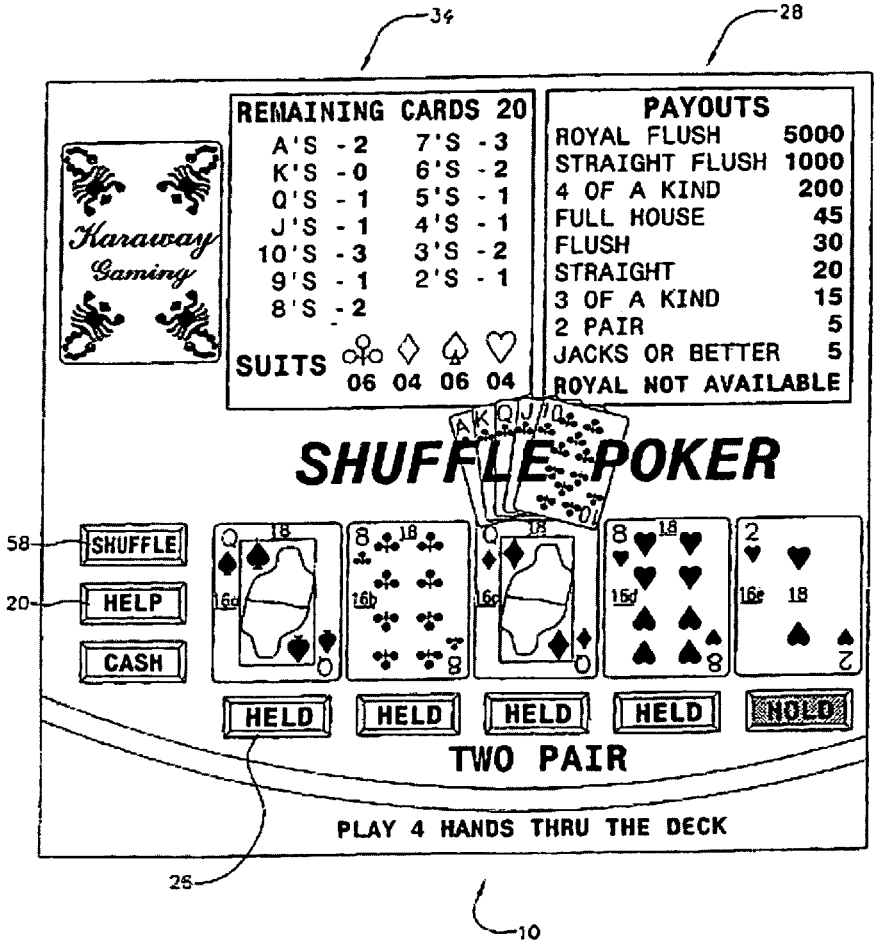
FIG. 2 shows the processor controlled display after the play of another hand of play of Video Poker.

Turning to the drawings, FIGS. 1 and 2 show an electronic display 10 for the game and method according to some embodiments of the present invention. The display 10 may be presented by a video display or plasma display for a gaming machine or on a computer monitor or handheld game display.

With reference to FIG. 1, a device 10 and method for a Video Poker embodiment of the present invention is shown. In some embodiments, the device 10 includes an electronic video display 12 presenting an example of the layout for the play of the game. The device 10 may be incorporated into any platform such as those currently known in the art. For example, the display 12 may be a touch screen display including data input means 14 to control the game/machine processor 15; however it should be understood that other data input means could be used such as machine buttons, mouse, keyboard or the like.

In some embodiments, the display 12 has a locations 16*a e* for the display of the game hand cards 18 during play. During the play of the device 10 and method, cards 18 are displayed in a manner as hereinafter described to play the game method in some embodiments.

Not shown in FIGS. 1 and 2, the device 10 and/or display 12 may include a credit meter, as is known on the art, to keep a tally on the gaming credits available for play and means for the player to input a wager and prompt play of the game. For example, the device may include a cash reader or token acceptor by which the player may input the desired wager as well as input means to wager accumulated credits, again as is known in the art.

To provide information to the player, the display 12 may include a touch screen help button 20 which, if touched by the player, prompts the processor 15 to display helpful information to the player. Also included in some embodiments is a cash out button 22 which if touched by the player prompts the processor 15 to operate a pay device 24 which may be a coin hopper device, voucher writer, credit or debit card writer or a program to transfer accumulated credits to the player's established account.

In some embodiments, to enable the player to hold/discard cards 18, each location 16*a e* has associated therewith a hold button 26. In some embodiments, as is known in the play of Video Poker, if the player desires to hold a card 18, he/she touches the corresponding hold button 26 which prompts the processor 15 for the game to retain the display of the held card 18. Cards which are not held in the initial hand or holding, are replaced with replacement cards to define the final, outcome, holding. The final holding, as described below, is compared to an established pay table to determine if the player has a winning or losing outcome.

In some embodiments, the processor 15 controls the display 12 to also display a pay table which lists winning outcomes and the pay for each. Data corresponding to winning combinations and the pay or award for each may be stored in a second data structure 32

In some embodiments, data representing the deck of N cards for play of the game is stored in a first data structure 30, such as a digital memory device. Where the deck is a single, standard deck, N=52 cards. The data may be stored in a serial order, each address representing a playing card of the deck. In some embodiments, the data is stored in a fashion to replicate a shuffled deck of playing cards. For example, when newly shuffled for play, the card data is stored in the first data structure 30 as a sequential string of card data representing cards N.sub.1 N.sub.52. In this example, the cards in the addresses N.sub.1 N.sub.52 are not in any suit or value order but instead are randomized simulating a shuffled deck of cards, with the top card being N.sub.1 and the bottom card being N.sub.52. In some embodiments, a random number generator may be used to randomly select cards for each address. Thus, to the processor 15 and first data structure 30, the data is arranged in a fashion similar to that of a shuffled deck of cards in some embodiments. It should be recognized, that these examples are non-limiting, and as discussed below, other embodiments may include other elements and/or methods.

In some embodiments, when the play of the game is prompted after shuffling (reconstitution and reconfiguration of the data), the processor 15 selects the first five addresses N.sub.1 N.sub.5 in the data structure defining the initial holding and, with that data, displays the corresponding cards at the display in locations 16*a e* as shown in FIG. 1. In some embodiments, the next card selected would be N.sub.6. In some embodiments, if, on the other hand, the last card displayed form the previous game was at address position N.sub.20, the processor would access address positions N.sub.21 N.sub.25 and display the cards corresponding to those addresses. Of course other arrangements of data may be used to simulate the ordered, serial and random arrangement of cards in a shuffled deck. It should be recognized that these examples are not limiting and that other embodiments may include other methods or elements.

In some embodiments, the processor 15 controls the display 12 to display a table 34 which describe the inventory data representing cards of the first data structure 30. Table 34 is updated as card data is selected and cards displayed to impart information as to the remaining constituency of the data, i.e. how many of each card are left in the inventory.

Figure 3:
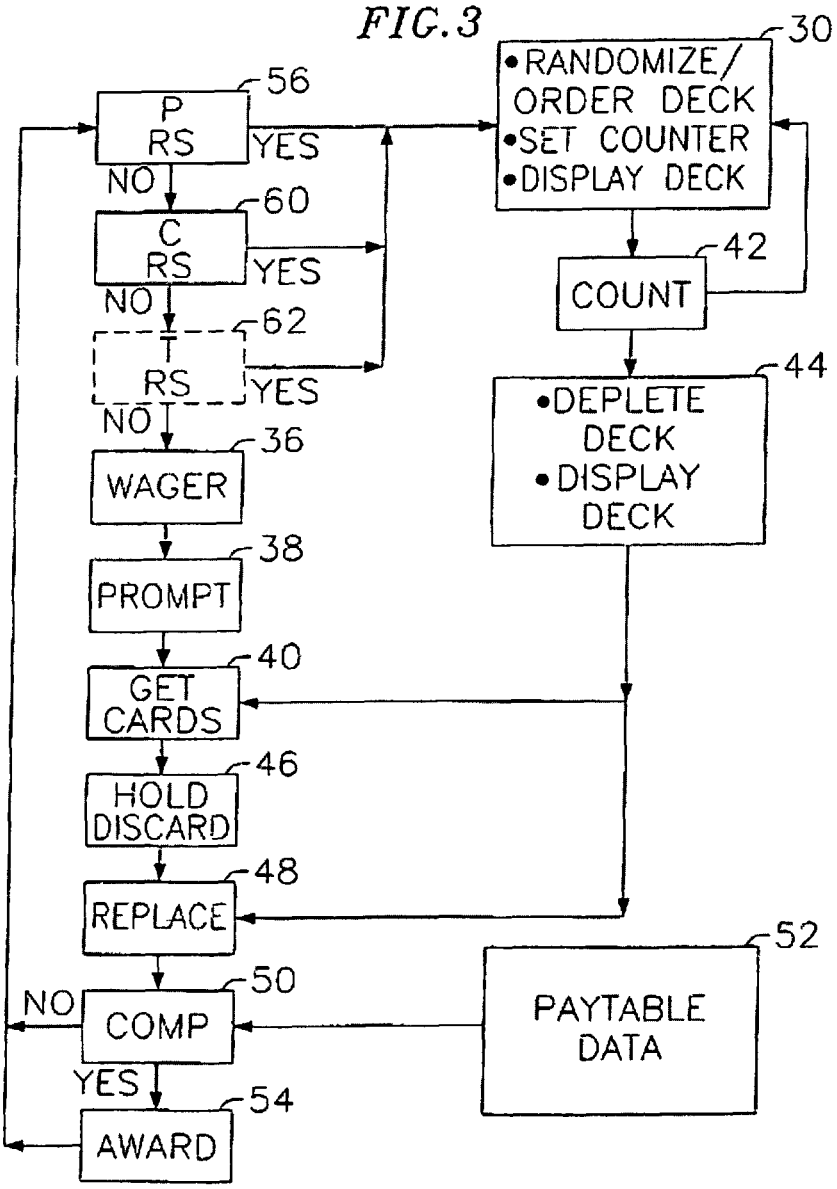
FIG. 3 illustrates a flowchart for a game of Video Poker.

With reference to FIGS. 1 and 3, a method of the play and the device 10 for Video Poker will now be described.

Video Poker

In this example, at 36 the player inputs their desired wager to play a hand of Video Poker and at 38 prompts the processor 15 for play. In this example, the processor 15 accesses the first data structure 30 to get the next cards 18 at 40 in order from the random, serially arranged, deck data. For purposes of discussion and with reference to FIG. 1, it is assumed that the deck data of the first data structure 30 has been re-randomized, reconstituted and serially ordered into data representing a complete shuffled deck of fifty-two cards N.sub.1 N.sub.52. Thus, at 40, the processor 15 gets cards N.sub.1 N.sub.5 and displays the same at the display 12 as an initial five card holding of, according to this example, 103A410 (FIG. 1). It should be recognized that this is given as an example only.

With continuing reference to the example of FIG. 3, the processor 15 also counts the number of cards which the current hand has depleted from the deck at 42 as well as accounts for the value, and if desired suit, of the cards remaining in the deck data inventory of the first data structure 30. Thus, if the deck data was a full deck of fifty-two cards of a standard deck of playing cards, the deck by the retrieval and display of five playing cards has been (1) depleted of five cards and (2) specifically depleted of cards 103A410. The processor re-tabulates the table 34 to account for the depletion of the deck. That is, before and after the display of the cards of the initial holding the table 34 would be altered as suggested below and as reflected in FIG. 1:

TABLE-US-00001

| Table Before Initial Deal | | Table After Initial Deal | |
|---|---|---|---|
| A`s | 4 | **A`s** | 3 |
| K`s | 4 | K`s | 4 |
| Q`s | 4 | Q`s | 4 |
| J`s | 4 | J`s | 4 |
| 10`s | 4 | **10`s** | 2 |
| 9`s | 4 | 9`s | 4 |
| 8`s | 4 | 8`s | 4 |
| 7`s | 4 | 7`s | 4 |
| 6`s | 4 | 6`s | 4 |
| 5`s | 4 | 5`s | 4 |
| 4`s | 4 | **4`s** | 3 |
| 3`s | 4 | **3`s** | 3 |
| 2`s | 4 | 2`s | 4 |
| | 52 | | 47 |

(Bold cards reflect deck constituency change)

Thus, in this non-limiting example, at 44 the processor depletes the deck data of the first data structure 30 and displays the remaining constituency of the card data so the player knows which cards remain available for selection and display.

With reference to the example of FIG. 3, at 46 the player selects with the input means 14 which cards of the initial holding to hold. For example, with reference to FIG. 1 the player may decide to hold the 10's. Thus the display 12 would display the cards 18 in the following manner:

TABLE-US-00002

| | | | | |
|---|---|---|---|---|
| 10,<br>Hold | 3, | A, | 4, | 10,<br>Hold |

In this example, upon the player prompting play, at 48 the processor 15 selects from the data stored in the first data structure the next data, e.g. N.sub.6 N.sub.8 and displays the same as replacements for the discarded cards 3A4. For example, the hand, after replacements may result in a final holding outcome of:

TABLE-US-00003

| | | | | |
|---|---|---|---|---|
| 10,<br>Hold | 10, | J, | J, | 10<br>Hold |

This holding is a Full House.

In this example, in connection with the retrieval of the replacement card data, the processor at 44 depletes the deck data of the data representing the replacement cards (cards 10.diamond., JJ) and displays at the display 12 at table 34 the new constituency of the deck depleted by the replacement card data. Thus the table 34 would be:

TABLE-US-00004

| Table After Initial Deal | | Table After Replacements | |
|---|---|---|---|
| A's | 3 | A's | 3 |
| K's | 4 | K's | 4 |
| Q's | 4 | Q's | 4 |
| J's | 4 | **J's** | 2 |
| 10's | 2 | **10's** | 1 |
| 9's | 4 | 9's | 4 |
| 8's | 4 | 8's | 4 |
| 7's | 4 | 7's | 4 |
| 6's | 4 | 6's | 4 |
| 5's | 4 | 5's | 4 |
| 4's | 3 | 4's | 3 |
| 3's | 3 | 3's | 3 |
| 2's | 4 | 2's | 4 |
| | 47 | | 44 |

(Bold cards reflect deck constituency change)

Thus the player has updated information as to the constituency of the remaining deck data.

In this example, at 50 the processor 15 compares the outcome to data stored in a second data structure 52 representing winning outcomes and the award for each (referred to herein as pay table data) to determine if the player is entitled to an award. If the player has obtained a winning outcome, at 54 the processor 15 issues the appropriate award. Typical pay table data for a five unit wager is as shown at the pay table 28 of FIG. 1. The pays may be linear based upon the tokens wagered or may include one or more higher pays to encourage a maximum coin wager.

In some embodiments, after the award or if no award was won, the processor 15 determines at 56 if the player has prompted re-shuffling of the deck data of the first data structure 30. In some embodiments, the player may prompt reconfiguration and reconstitution of the deck data of the first data structure into data representing a shuffled, random, serially ordered full deck by touching shuffle button 58 (FIG. 1). In some embodiments, the processor 15 reconfigures and reconstitutes the deck data of the first data structure 30 into data representing cards N.sub.1 N.sub.52. In some embodiments, the display 12 would also be controlled to show the constitution of the deck data at table 34. In some embodiments, the player may command re-shuffling where the deck constitution, for the next hand of play, is not what the player desires, e.g. is completely depleted of Aces thus making a Royal Flush impossible for the next hand. It should be noted that where deck depletion makes certain outcomes impossible for the next hand, the processor 15 would re-configure the pay table 28 and remove that outcome in some embodiments. For example, if all Kings are depleted from the deck making a Royal Flush impossible, the Royal Flush pay would be removed from the pay table 28.

In some embodiments, if the player does not command re-shuffling, re-shuffling may be commanded based upon the count of the card data which has been displayed.

According to some embodiments, where penetration into the deck data reaches a predetermine number, the processor 15 commands reconfiguration and reconstitution of the deck data. For example, if the count exceeds 30 cards, e.g. (N.sub.1 N.sub.31), at 60 the deck data is reshuffled before the play of the next hand in some embodiments.

In some embodiments, one or more triggers at 62 may trigger re-shuffling and reconstitution of the deck. For example, where the game is a Joker's Wild version of Video Poker, the display of the Joker in the hand may trigger re-shuffling before the play of the next hand. Other triggers may be depletion of one of A's 10's from the deck (making a Royal Flush impossible) or depletion of all the 2's in a Deuces Wild format game.

In some embodiments where re-shuffling takes place, the table 34 may reflect the re-constitution of the deck.

Table 34 may also display the cards remaining for each suit as shown in the example of FIG. 1.

In some embodiments, whether re-shuffling takes place or not, the player at 36 inputs another wager to play the next hand having the information imparted by the table 34 of the constitution of the deck data.

The example of FIG. 2 illustrates the display 12 after completion of a hand which has depleted the deck data to have a remaining set of 32 cards. Since the next hand could require the selection and display of ten cards (initial holding of five cards where all are discarded and replaced) thereby exceeding a forty card deck penetration, re-shuffling of the deck data would occur prior to the play of the next hand in some examples.

As suggested above, the device and method may be configured to play a Deuces Wild or Joker's Wild game. In some embodiments for Joker's Wild, data is stored in the first data structure 30 representing a standard deck (52 cards) plus at least one Joker for data representing fifty-three cards. In some embodiments only one Joker is included and is "wild" to represent any card in the deck. In some embodiments for Joker's Wild the pay table data stored in the second data structure 32 represents the following winning combinations and awards for a five unit wager:

TABLE-US-00005

| | |
|---|---|
| Royal Flush (without Joker) | 5000 |
| 5 of a Kind | 1000 |
| Royal Flush with Joker | 500 |
| Straight Flush | 250 |
| 4 of a Kind | 100 |
| Full House | 35 |
| Flush | 25 |
| Straight | 15 |
| 3 of a Kind | 10 |
| Two pair | 5 |
| Pair of Queens or Better | 5 |

In some embodiments, the processor 15 is programmed to order re-shuffling (reconfiguration and reconstitution) of the deck data upon the first of: (1) where the count the hands played as tracked by the counter 42 is four hands (2) after a hand is played including the Joker, or (3) player commanded re-shuffling.

Blackjack/Baccarat

Figure 4:
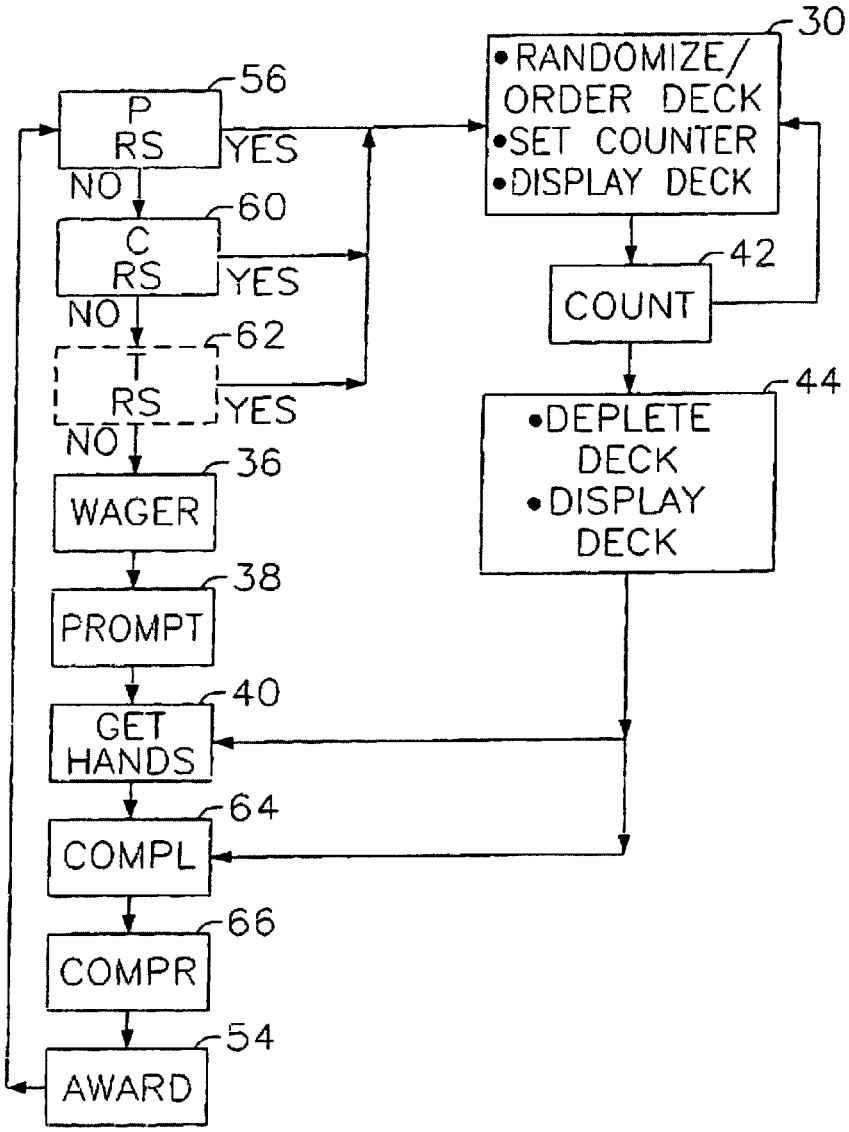
FIG. 4 illustrates a flowchart for a game of Blackjack or Baccarat.

Turning to the example of FIG. 4, there is shown a diagram for the play of Blackjack or Baccarat according to the present invention. Like elements bear like reference numbers.

In some embodiments, at 36 the player inputs their desired wager to play a hand of Baccarat or Blackjack and at 38 prompts the processor 15 for play. In some embodiments, the processor 15 accesses the first data structure 30 to get the next cards at 40 in order from the random, serially arranged, deck data. In some embodiments for Blackjack, the processor would select and display two cards for a player hand and two cards for a dealer hand; however for the dealer hand, only one card is exposed. Thus, at 44, the deck data is depleted by four cards displayed for the initial holding and the constituency of the remaining deck is displayed at table 34 in some embodiments.

With continuing reference to FIG. 4, the processor 15 also counts at 42 the number of cards (and/or hands of play, if desired) represented by the current hand as well as accounts for the value, and if desired suit, of the cards remaining in the deck data inventory of the first data structure 30 in this example. For Baccarat or Blackjack, suit is not important and hence may not be accounted for in some implementations.

In some embodiments, at 64 the hands are completed by the player standing, splitting, doubling down, taking a hit according to the rules of Blackjack. The player's action may require the selection and display of additional cards for the player hand. In some embodiments, for additional cards requested by the player, at 44 and as described above, the deck data is selected in order from the serially arranged, randomized deck data, cards are counted at 42, at 44 the deck data is depleted and the new deck constituency is displayed. In some embodiments, the dealer's hand at 64 is also completed which may require selecting and displaying additional cards according to the well-known rules of the game. In some embodiments, for any additional cards for the dealer's hand, cards are counted at 42, at 44 the deck data is depleted and the new deck constituency is displayed. It should be recognized that this example is non-limiting and that other elements and/or methods may be used in other embodiments.

In some embodiments, when the player and dealer hands have been completed, at 66 the hands are compared, according to the well known rules of the game to determine if the player has won the hand. If the player has won at 54 the award is issued to the player and if not, the player's wager is lost and is retained.

In some embodiments, after the award or if no award was won, the processor 15 determines at 56 if the player has prompted re-shuffling of the deck data of the first data structure 30. In some embodiments, the player may prompt reconfiguration and reconstitution of the deck data of the first data structure 30 into data representing a shuffled, random, serially ordered full deck by touching shuffle button 58 (FIG. 1). In some embodiments, the processor 15 reconfigures and reconstitutes the deck data of the first data structure 30 into data representing cards N.sub.1 N.sub.52 for the fifty-two card deck. In some embodiments, the display 12 would also be controlled to show the constitution of the deck data at table 34. In some embodiments, the player may command re-shuffling where the deck constitution, for the next hand of play, is not what the player desires, e.g. is completely depleted of Aces thus making a Blackjack impossible for the next hand. It should be recognized that his example is non-limiting and other embodiments may include other elements or methods.

In some embodiments, if the player does not command re-shuffling, re-shuffling may be commanded based upon the count of the card data which has been displayed or additionally or alternatively, the number of hands which have been played since re-shuffling of the deck. According to some embodiments, where penetration into the deck data or the number of hands of play reaches a predetermine number, the processor 15 commands reconfiguration and reconstitution of the deck data. For example, if the count exceeds 30 cards, e.g. (N.sub.1 N.sub.31), at 60 the deck data is reshuffled before the play of the next hand in some embodiments. Or, in some embodiments, if four hands have been played, re-shuffling may be triggered.

In some embodiments, one or more triggers at 62 may trigger re-shuffling and reconstitution of the deck. For example, where all the Aces have been depleted from the deck (making a Blackjack impossible), re-shuffling may be triggered before the play of the next hand in some embodiments.

In some embodiments, Baccarat is played in the same manner as illustrated in FIG. 4 and described above. The difference is the exposure of all cards and the known draw rules for Baccarat to complete the Player and Banker hands therefore.

The device and method may also be applied to other casino card games such as modified Blackjack, Baccarat or Poker games. Further the method can also be employed in a table game using one or more decks of cards and a card reader to read cards as they are distributed to players.

[In some embodiments, selecting a game indicia and/or card may include selecting a value for the card and a suit for the card. In some implementations, the value and suit may be selected separately. The value may include, for example, a face value (e.g., a two, a three, an ace, a king, a queen, etc.) The suit may include, for example, a heart, a spade, a diamond, or a club.

In some embodiments, a value may e selected with reference to an inventory of available game indicia/card or other card data. The value may be selected based on the available game indicia. For example, the value may be selected from the inventory depleted of values that have previously been selected. For example, an inventory may begin with 4 tens, but after a ten has been dealt, the inventory may have only 3 tens. Selecting a value may include using a random number generator to select a value from the remaining inventory of values, and/or any other method of selecting a value from a remaining inventory of values.

In some embodiments, the selected value, may correspond to a generic card without a suit. Unlike embodiments discussed above in which a selected card and/or indicia includes both a value and a suit, in this embodiments, the selected value does not include a suit.

In some embodiments, a suit may be selected from the four possible suits. Accordingly, in a deck, all cards of a value may have the same suit. In some implementations, a game played in this method may have outcomes that are not determined by a suit of a card. Such a game may include blackjack. The suit may be selected by a random number generator or any other method. The suit may be selected without reference to an inventory and/or card data. The suit may be selected separately from the value.

In some embodiments, the inventory or other information about card values remaining in an inventory may be displayed.

In some embodiments, after a value is selected, a number of indicia in an inventory that have the same value may be reduced and/or depleted to reflect the selection of the value. No specific card may be eliminated by such reduction in some examples, because the suit of the cards remaining is determined separately from the value. Accordingly, in some such embodiments, a deck may end up having multiple cards of the same suit even though a standard deck may not have such duplicates.

While certain embodiments of the present invention have been described, it should be understood that these embodiments are subject to many modifications and changes without departing from the spirit and scope of the appended claims.

What is claimed is:

1. A method for playing a card game according to the rules thereof comprising:

(a) storing, by a data processor, data representing each playing card of at least one deck of N playing cards used according to the rules of the game in a first data structure;

(b) receiving, by the data processor, an indication of a player making a wager to play a hand of the game and prompting play;

(c) according to the rules of the game, displaying, by the data processor, cards randomly selected by the processor by a) selecting a respective face value of each of the cards with reference to card data stored in the first data structure and b) selecting a respective suit of each of the cards without reference to the card data stored in the first data structure to define an outcome for the hand;

(d) assessing the outcome for the hand to determine if the outcome is a winning outcome according to the predetermined rules of the game and if the outcome is a winning outcome issuing an award to the player;

(e) depleting, by the data processor from the first data structure, card data having a same value as cards which have been selected and displayed;

(f) displaying information to the player of any winning outcomes eliminated by said depletion; and (g) to play subsequent hands repeating steps (b)-(f).

2. The method of claim 1 wherein the card game includes a game of blackjack.

3. The method of claim 1, wherein selecting the value of each card includes selecting a value for each card based on the inventory of indicia and selecting a suit for each card from the four possible suits without reference to the inventory.

4. A method for playing a card game according to the rules thereof comprising:

(a) storing, by a data processor, data representing each playing card of at least one deck of N playing cards used according to the rules of the game in a first data structure;

(b) receiving, by the data processor, an indication of a player making a wager to play a hand of the game and prompting play;

(c) according to the rules of the game, displaying cards randomly selected by the processor from the first data structure to define an outcome for the hand;

(d) assessing the outcome for the hand to determine if the outcome is a winning outcome according to the predetermined rules of the game and if the outcome is a winning outcome issuing an award to the player;

(e) depleting, by the data processor from the first data structure, card data available for selection and display for subsequent selection and display of card data, the depleted card data including data representing cards having a same face value and a different suit as cards which have been previously selected and displayed;

(f) displaying information to the player of any winning outcomes eliminated by said depletion; and (g) to play subsequent hands repeating steps (b)-(f).

5. The method of claim 4 wherein the card game includes a game of blackjack.

6. A method for playing a card game according to the rules thereof and using an inventory of playing cards including the four suits of Clubs, Diamonds, Hearts and Spades the method comprising:

storing, by a processor of a computing device, data representing said inventory of each playing card;

receiving, by the computing device, an indication of a player making wagers to play a series of hands of the game, each hand of the series played by the processor selecting (1) an initial set of cards by a) selecting a respective face value of each card with reference to the inventory and b) selecting a respective suit of each card without reference to the inventory and (2) selecting an additional or replacement set of cards from said inventory to produce a final, concluding, outcome for the hand, excluding, by the processor, from selection and display in subsequent hands data for cards with a value that is the same as cards which have been selected and displayed in prior hands by depleting said inventory;

displaying data corresponding to a game outcome eliminated by said exclusion; and issuing an award to the player for any hand of the series having a predetermined winning final outcome.

7. The method of claim 6 wherein the card game includes a game of blackjack.

8. The method of claim 6, wherein selecting the value of each card includes selecting a value for each card based on the stored data and selecting a suit for each card from the four possible suits without reference the stored data.

9. A method for playing a card game according to the rules thereof and using an inventory of playing cards including the four suits of Clubs, Diamonds, Hearts and Spades the method comprising:

storing, by a processor of a computing device, data representing said inventory of each playing card;

receiving, by the computing device, an indication of a player making wagers to play a series of hands of the game, each hand of the series played by the processor selecting and displaying (1) an initial set of cards and (2) selecting additional or replacement set of cards from said inventory to produce a final, concluding, outcome for the hand, excluding, by the processor for subsequent games, from selection and display in subsequent hands data for some cards that have a same face value and a different suit as cards which have been selected and displayed in prior hands by depleting said inventory;

displaying data corresponding to a game outcome eliminated by said exclusion; and issuing an award to the player for any hand of the series having a predetermined winning final outcome.

10. The method of claim 9 wherein the card game includes a game of blackjack.

11. An electronic device for playing a card game according to the rules thereof and using an inventory of playing cards including the four suits of Clubs, Diamonds, Hearts and Spades the device comprising:

a data structure storing data representing an inventory of each playing card;

a video display;

means for a player to input wagers to play a series of hands of the game;

a processor configured to select (1) an initial set of cards by a) selecting a respective face value of each indicia with reference to the inventory and b) selecting a respective suit of each card without reference to the inventory, and (2) select an additional or replacement set of cards from said inventory to produce a final, concluding, outcome for the hand, said processor configured to exclude from selection, data for cards that have a same value as cards which have previously been selected and displayed and to display data corresponding to a game outcome eliminated by said exclusion; and said processor configured to determine if said outcome for the hand is a winning final outcome and if so to issue an award to the player.

12. The method of claim 11 wherein the card game includes a game of blackjack.

13. The method of claim 11, wherein selecting the value of each card includes selecting a value for each card based on the stored data and selecting a suit for each card from the four possible suits without reference to the stored data.

14. An electronic device for playing a card game according to the rules thereof and using an inventory of playing cards including the four suits of Clubs, Diamonds, Hearts and Spades the device comprising:

a data structure storing data representing said inventory of each playing card;

a video display;

means for a player to input wagers to play a series of hands of the game;

a processor configured to select and display at said display (1) an initial set of cards and (2) an additional or replacement set of cards from said inventory to produce a final, concluding, outcome for the hand, said processor configured to exclude from selection and display in subsequent hands, data for some cards that have a same face value and a different suit as cards which have previously been selected and displayed in prior hands, and to displaying data corresponding to a game outcome eliminated by said exclusion; and said processor configured to determine if said outcome for the hand is a winning final outcome and if so to issue an award to the player.

15. The method of claim 14 wherein the card game includes a game of blackjack.

* * * * *